US008173064B2

(12) United States Patent
König et al.

(10) Patent No.: US 8,173,064 B2
(45) Date of Patent: May 8, 2012

(54) METHOD FOR OPERATING A SHAFT FURNACE, AND SHAFT FURNANCE OPERABLE BY THAT METHOD

(75) Inventors: Gerd König, Dinslaken (DE); Wolfram König, Ibbenbüren (DE); Hans-Heinrich Heldt, Viersen (DE); Dieter-Georg Senk, Aachen (DE); Heinrich-Wilhelm Gudenau, Aachen (DE); Alexander Babich, Aachen (DE)

(73) Assignee: Thyssenkrupp At.Pro Tec GmbH, Essen (DE)

( * ) Notice: Subject to any disclaimer, the term of this patent is extended or adjusted under 35 U.S.C. 154(b) by 950 days.

(21) Appl. No.: 12/092,822

(22) PCT Filed: Nov. 9, 2006

(86) PCT No.: PCT/EP2006/010752

§ 371 (c)(1),
(2), (4) Date: Jun. 14, 2008

(87) PCT Pub. No.: WO2007/054308

PCT Pub. Date: May 18, 2007

(65) Prior Publication Data

US 2008/0237944 A1 Oct. 2, 2008

(30) Foreign Application Priority Data

Nov. 9, 2005 (DE) ..... 10 2005 053 505

(51) Int. Cl.
*C21B 13/02* (2006.01)

(52) U.S. Cl. ..... 266/187; 266/197; 266/44; 75/375

(58) Field of Classification Search ..... 266/197, 266/187, 80, 44; 75/330, 375, 378
See application file for complete search history.

(56) References Cited

U.S. PATENT DOCUMENTS 2,814,479 A * 11/1957 Leone ..... 266/81

(Continued)

FOREIGN PATENT DOCUMENTS

BE 794545 A1 7/1973

(Continued)

OTHER PUBLICATIONS

Pipatmanomai S. et al.: "Investigation of Coal Conversion Under Conditions Simulating the Raceway of a Blast Furnace Using a Pulsed Air Injection, Wire-Mesh Reactor", Energy Fuels; Energy and Fuels Mar./Apr. 2003, Bd. 17, Nr. 2, Mar. 2003, pp. 489-497, XP002442344.

(Continued)

*Primary Examiner* — Scott Kastler
*Assistant Examiner* — Michael Aboagye
(74) *Attorney, Agent, or Firm* — Pearne & Gordon LLP

(57) ABSTRACT

Method for operating a shaft furnace, whereby an upper section of the shaft furnace is charged with raw materials which due to gravity descend inside the furnace while the atmosphere prevailing within the shaft furnace causes part of the raw materials to melt and/or to be reduced, and in a lower section of the shaft furnace a process gas is injected so as to at least partly modify the atmosphere prevailing in the shaft furnace. The pressure and/or volume flow of the injected process gas is dynamically modulated within a time span of 40 s. Also, a shaft furnace operable by said method, thus achieving improved through-gassing.

23 Claims, 3 Drawing Sheets

U.S. PATENT DOCUMENTS

| | | | | |
|---|---|---|---|---|
| 3,193,271 | A | | 7/1965 | Tsujihata et al. |
| 3,764,299 | A | | 10/1973 | Wenzel |
| 4,031,183 | A | * | 6/1977 | Rourke ..... 423/175 |
| 4,097,225 | A | * | 6/1978 | Rourke ..... 432/96 |
| 4,588,437 | A | * | 5/1986 | Kepplinger et al. ..... 75/445 |
| 6,666,747 | B1 | | 12/2003 | Buntz |

FOREIGN PATENT DOCUMENTS

| | | | |
|---|---|---|---|
| CN | 1298027 | A | 6/2001 |
| DE | 1 012 944 | A | 8/1957 |
| DE | 1 229 564 | A | 12/1966 |
| EP | 0992754 | A | 4/2000 |
| EP | 1035392 | A | 9/2000 |
| GB | 932977 | | 7/1963 |
| JP | S44-006565 | | 3/1969 |
| JP | S45-000402 | | 1/1970 |
| JP | H01-162708 | A | 6/1989 |
| JP | 2002-121609 | A | 4/2002 |
| WO | 01/36891 | A | 5/2001 |

OTHER PUBLICATIONS

Form PCT/IB/326 (Notification Concerning Transmittal of International Preliminary Report on Patentability Chapter 1 of the PCT, Form PCT/IB/373 (International Preliminary Report on Patentability).

* cited by examiner

METHOD FOR OPERATING A SHAFT FURNACE, AND SHAFT FURNANCE OPERABLE BY THAT METHOD

BACKGROUND OF THE INVENTION

This invention relates to a method for operating a shaft furnace, whereby an upper section of the shaft furnace is charged with raw materials which, due to the effect of gravity, descend in the furnace while the atmospheric conditions prevailing in the shaft furnace cause part of the raw material to melt and/or to be reduced, and in a lower section of the shaft furnace a process gas is injected to at least partially control the atmosphere prevailing in the shaft furnace; as well as to a shaft furnace suitably designed for the application of said method, such as a blast furnace, a cupola furnace or a garbage incinerator.

PRIOR ART

A corresponding method, i.e. a shaft furnace of that type, has essentially been known. It is predominantly used as the main system for producing the primary melt of iron, with other methods merely constituting a relative proportion of about 5% of the process. The shaft furnace can work along the counter-current principle. Raw materials such as burden and coke are charged through the throat of the furnace top from where they descend within the shaft furnace. In a lower section of the furnace (at the tuyère level) a process gas (forced gas of 800-10,000 $m^3$/tRE depending on the size of the furnace) is forced into the furnace through tuyères. That forced gas, usually air preheated in cowpers to about 1000 to 1300° C., reacts with the coke, generating carbon monoxide, inter alia. The carbon monoxide rises in the furnace and reduces the iron ore contained in the burden.

Also commonly injected in the furnace to promote the generation of carbon monoxide are supplemental reducing agents (such as coal dust, oil or natural gas) for instance at 100-170 kg/tRE.

Apart from the iron ore reduction, the raw materials melt as a result of the heat generated in the shaft furnace by the chemical processes involved. However, the temperature distribution across the shaft furnace is uneven. In the center of the shaft furnace this leads to the formation of a phenomenon called the "dead man" while the important processes such as the gasification (the reaction of oxygen with coke or substitute reducing agents into carbon monoxide and carbon dioxide) essentially take place only in the so-called vortex zone, a region in front of a tuyère and thus only located in a peripheral area in relation to the cross section of the furnace. The depth of this vortex zone toward the center of the furnace is about 1 meter, its volume about 1.5 $m^3$. At the tuyère level there are usually several tuyères positioned around the furnace circumference in such fashion that the vortex zone created in front of each tuyère overlaps on the left and right with neighboring vortex zones, thus forming an essentially circular active region. During the operation of the shaft furnace that region constitutes the so-called bird's nest.

Usually it is also possible to enrich the hot forced gas with oxygen so as to intensify the processes described above (gasification in the vortex zone, iron ore reduction), thus enhancing the performance of the shaft furnace. The hot forced gas may be oxygen-enriched prior to being injected or, alternatively, pure oxygen may be introduced separately, such separate introduction taking place by means of a so-called lance, a tube extending for instance within the tuyère, itself a tubular element, and exiting in the port area of the tuyère that leads into the furnace. Especially in the case of modern blast furnaces using low coke amounts the hot forced gas is subjected to corresponding high-concentration oxygen enrichment. On the other hand, the addition of oxygen increases the production cost so that the effectiveness of a modern blast furnace cannot be simply increased by injecting an ever higher oxygen concentration.

As another known fact, there is a correlation between the efficiency or level of effectiveness of a modern shaft furnace and the so-called through-gassing, the gas flow through the shaft furnace. In general terms this depends on how well the gasification in the vortex zone reduces the iron ore and how well the gas phase present in the shaft furnace rises from the tuyère level to the furnace top where the so-called off-gas is discharged. One indication of improved through-gassing is provided for instance by the minimum possible pressure drop in the furnace.

SUMMARY OF THE INVENTION

It has been found, however, that in spite of an oxygen-enriched hot forced gas the through-gassing in modern blast furnaces is still not entirely satisfactory. It is therefore the objective of this invention to introduce a method for operating a shaft furnace that ensures improved through-gassing.

In procedural terms the objective is achieved using a method as described above, with a dynamically modulated injection of the process gas. The modulation of the process gas takes place in a manner whereby the process pressure p and/or the volume flow $\dot{V}$ are varied within a time span of $\leqq 40$ s. More specifically, the change in the pressure and/or volume flow takes place within a time span of $\leqq 20$ s, preferably $\leqq 5$ s and most desirably $\leqq 1$ s. This is based on the discovery that clearly improved through-gassing, and thus a corresponding performance and efficiency enhancement, is achieved when the process gas is not introduced in the furnace all at once but in varied increments at short time intervals.

Of course, there is a variation in the injection of the process gas even in the case of conventional methods, i.e. every time the furnace is started up or shut down, whenever different process variables are set for a new charge of raw material, or simply when for a performance boost, the oxygen concentration in the hot forced gas is increased to a higher level. These variations in time, however, are merely of a one-time nature taking place within a time frame of several hours. By contrast, the dynamically modulated injection of the process gas takes place within time frames of less than a minute, which relates to the fact that the mean dwell time of the gas in the shaft furnace is only 5 to 10 s. Compared to the dynamic modulation according to the invention, time variations of the process variables at intervals in excess of one minute offer a comparatively limited time span during which the process variables are non-static. This means that the time span between two changes in the process variables during which these process variables remain essentially constant, i.e. static, is longer than the time span needed for attaining the essentially stationary condition. Except for the relatively short switch-over times these variations are largely static and are therefore referred to as "quasi static modulation". In the case of the dynamic modulation according to the invention the time span with non-stationary conditions in the shaft furnace is greater than the time span with essentially stationary conditions.

This dynamic modulation stirs up zero-movement regions in the vortex zone, thus increasing the overall turbulence in the vortex zone with the result of improved through-gassing in the vortex zone and thus in the stack.

Such modulation is particularly beneficial when performed in quasi-periodic and especially periodic fashion, with the periodic cycle time T being less than 40 s, preferably 20 s or less and ideally 5 s or less. A periodic modulation is characterized by a time-variable function f(t) where f(t+T)=f(t), coincidentally defining the periodic cycle time T. The term quasi-periodic modulation indicates, on the one hand, that a base modulation is of a periodic nature, for instance a function $h(t)=g(t)\cdot f(t)$ having a periodic f(t) and an envelope function g(t) which, compared to f(t), has only a minor qualitative effect on the structure of h(t). On the other hand, a quasi-periodic modulation could be viewed as one where g(t) is a steady but random function which, in a way, unevenly distorts the structure of the steady function f(t), although the underlying periodic structure remains recognizable. A periodic modulation of that nature can engender a similarly periodic process taking place in the vortex zone, leading to further improved through-gassing.

From the practical point of view, the cycle time T should be 60 ms or longer, preferably 100 ms or longer and especially 0.5 s or more. Although the dwell time of the process gas in the vortex zone is extremely short, cycle times in the ranges indicated can lead to a satisfactory through-gassing rate, whereas generating a modulation of even shorter cycle times would involve greater technical complexity.

The cycle time T will therefore be $40\ s \geqq T \geqq 60$ ms, preferably $20\ s \geqq T \geqq 100$ ms, better yet $10\ s \geqq T \geqq 7$ s [sic] and ideally $5\ s \geqq T \geqq 0.5$ s. Specifically, T is so selected that the process gases create a turbulent flow in the shaft furnace and essentially prevent the formation of laminar regions.

In a simplified version of the method, the modulation follows a harmonic pattern. This is easily achievable with a simple sinusoidal modulation $f(t)=f_o+\Delta f \sin(2\pi t/T)$.

In a particularly desirable version of the method, the modulation is pulsed. A modulation of that nature can be characterized for instance by a function $f(t)=f_o+\Sigma_i\ \delta(t-t_i)$ where $\delta(t)$ generally describes a pulse, i.e. recurrent pulse peaks against an essentially constant background. The pulses proper may be rectangular/square, triangular or Gaussian-type pulses (expanded mathematical δ-pulse) or of a similar shape, with the exact pulse shape being less determinative than the pulse width σ which is the pulse width at half pulse height (FWHM). A useful pulse-width relation is obtained when σ is 5 s or less, preferably 2 s or less and especially 1 s or less. By the same token, it will be desirable to select a pulse width σ of 1 ms or more, preferably 10 ms or more and especially 0.1 s or more. Very small pulse widths are difficult to produce, although they permit intervention in processes that occur in the vortex zone with correspondingly short reaction times.

In one advantageous implementation of the method, the pulse width to cycle time ratio, σ:T, of the periodic pulsations is 0.5 or less, preferably 0.2 or less and especially 0.1 or less. The specific pulse width σ will therefore be $5\ s \geqq \sigma \geqq 1$ ms, preferably $0.7\ s \geqq \sigma \geqq 25$ ms, better yet $0.1\ s \geqq \sigma \geqq 30$ ms and most desirably $55\ ms \geqq \sigma \geqq 35$ ms.

The σ:T ratio should be $10^{-4}$ or greater, preferably $10^{-3}$ or greater and especially $10^{-2}$ or greater. This is conducive to a combination effect, addressing processes periodically occurring in the vortex zones and tied into specific reaction times.

In one possible implementation of the method, the modulation amplitude relative to a baseline value is 5% or greater, preferably 10% or greater and especially 20% or greater, based on the discovery that even small amplitude variations already permit satisfactory through-gassing. It will be desirable to limit the modulation amplitude relative to the baseline value to 100% or less, preferably 80% or less and especially 50% or less. Harmonic modulations are particularly easy to implement below these limits.

In pulsed modulation it may be advantageous for the pulse height to exceed the essentially unmodulated value between two pulses by a factor of 2 or more, preferably 5 or more and especially 10 or more. This allows for an augmented impact of the modulation which intensifies the break-up of the zero-flow regions in the vortex zone and ultimately improves the through-gassing in the furnace. On the other hand, it will be desirable for process-related reasons to limit that factor to 200 or less, preferably 100 or less and especially 50 or less.

In essence, the injection of the process gas can be modulated in a number of different ways. However, the modulation is preferably implemented by selecting at least one specific process variable controlling especially the injection of the process gas. For example, modulating the hot forced-gas pressure can accelerate gasification in the vortex zone, thus improving through-gassing in the stack. In pressure modulation it is possible to obtain peak pressures for instance of 300 bar. It will be particularly advantageous if the process gas being injected contains differentiable components. This, of course, refers not only to the obvious breakdown of a gas into its constituents (such as nitrogen, oxygen etc.) but also to the various gas phases that can be differentiated by virtue of the fact that in at least one stage of the injection they are introduced separately. An example consists in the separate feed-in of oxygen through lances, valves or diaphragms.

The effect achievable with the method according to the invention is further enhanced to a significant extent when, together with and/or in addition to the process gas, supplemental reducing agents are fed into the shaft furnace. As mentioned above, the supplemental reducing agents may be coal dust produced especially from hard coal, other metallurgical dust as well as small-particle materials, oil, grease, tar with natural gas or other hydrocarbon carriers, which due to the oxygen are converted into $CO_2$ and CO and are present primarily in the form of nano-particles. Modulation according to the invention can in fact result in a higher level of conversion of the supplemental reducing agents introduced. This is particularly true in the case of pulsed modulation since the pulses intensify the conversion. Moreover, by virtue of the aforementioned increase in the overall turbulence in the vortex zone, the very short dwell time of the supplemental reducing agents in the vortex zone will be extended from only about 0.03 s to 0.05 s, which again is conducive to an enhanced conversion of the reducing agents. In addition, an improved conversion of the supplemental reducing agents results in a smaller proportion of unburned particles, which in turn facilitates through-gassing in the area of the "bird's nest" and permits a further increase in the injection rate.

In other advantageous implementations of the method, the pressure and/or volume flow of at least one of the differentiable components of the process gas and/or the pressure and/or the mass flow of the supplemental reducing agent to be injected is/are dynamically modulated. Accordingly, through-gassing in the stack is assisted even further for instance by the pulsed feed-in of an additional oxygen component. As an alternative or in a combination process, the pressure or the mass flow at which the supplemental reducing agents are introduced can be dynamically modulated. Of course, as long as the density of the supplemental reducing agents remains unchanged, the mass flow and the volume flow will be identical, whereas even for a constant volume flow the average density of the supplemental reducing agents can be dynamically modulated. Moreover, it is possible at least periodically to fully or partly inject an inert gas for instance to level out temperature spikes or to cool down feed lines or valves installed in the feed lines.

The process variable referred to above consists ideally in the absolute quantity of one of the differentiable components of the process gas being injected and/or the proportional quantity of one of the differentiable components relative to another component or to the process gas as a whole. This makes it possible in particularly simple fashion to dynamically modulate for instance the absolute oxygen quantity or the relative oxygen concentration, even though it may not be necessary to modulate the main load, that being the hot forced gas itself. This is particularly easy to implement when pure oxygen, or a gas phase with an increased oxygen concentration relative to air, is separately introduced at least during part of the injection process. If that injection is performed in a pulsed mode, the conversion of the supplemental reducing agents can be further intensified, with the concomitant, enhanced effect mentioned above, in which context for instance the amplitude of the extra oxygen volume flow as related to the background forced gas may be in a range from 0.25-20%, preferably 0.5-10% and especially 1-6%.

This also serves as an example for the advantageous implementation of the method whereby two or more (different) process variables are modulated. Here it is altogether possible to combine the modulation of several variables such as hot forced-gas pressure, oxygen component, extra-oxygen pressure, the pressure or concentration of the supplemental reducing agents, etc., in which case it is necessary to weigh the trade-off between the added cost of another modulation and the incremental effect to be gained.

In a particularly preferred implementation of the method, the process gas is injected in the shaft furnace via at least two different channels, and a first process variable is dynamically modulated for the control of the component introduced along the first channel, while a second process variable is dynamically modulated for the control of the component introduced via the second channel, although the first and the second process variables may be identical variables whose modulation, however, may differ. As a general precept, the same or a different process variable can be dynamically modulated for each tuyère, meaning that the modulation of the process gas components introduced via the respective tuyères can take place individually, i.e. independently. It may be useful in each case to bundle a group of components being introduced through neighboring channels, thus creating independent injection groups that permit analogous modulation. This latter approach may serve for instance to sectorize the operation of the furnace while still permitting a uniform distribution of the process gas (hot forced gas) across the tuyères. In another advantageous implementation of the method, the first and the second process variables are modulated with an identical cycle time T but with a shift of their relative phase by a particular amount. The phase in this case is a time shift relative to the cycle time T. If, for example, the relative time shift is T/2, the two process variables will be modulated in mutually anticyclic fashion. In view of the combustion time in the vortex zones, however short, it may be desirable perhaps to slightly delay the oxygen pulses relative to corresponding pulsed increases in the amount of supplemental reducing agents, for instance shifted by $0 \leqq \phi \leqq \pi/2$.

In one particularly preferred implementation of the method, the inverse cycle time $T^{-1}$ is set at a characteristic self-resonant frequency of a partial system of the atmosphere within the shaft furnace. The term partial system of the atmosphere refers to a spatial subdivision composed in this case of the vortex zones but may also pertain to a physiochemical part of the atmosphere, such as the pressure distribution, thermal distribution, density distribution, temperature spread or composition. The self-resonant frequency may be the frequency of a linear stimulation in the radial direction (from the tuyères toward the center of the furnace) or of turbulent stimulations in the vortex zone of an individual tuyère, but also of a vortex-zone-transcending turbulent stimulation in the circumferential direction of the shaft furnace, with the "dead man" located in the spatial center of this stimulation constituting a topological hole for such vortical oscillation. Stimulating the partial system in one of its resonant frequencies can achieve a resonant through-gassing in the vortex zone(s) that is conducive to an improved overall through-gassing in the stack, thus enhancing the effectiveness of the shaft furnace. Particularly preferred is a modulation for instance of the pulse length, pulse frequency or pulse intensity in a manner whereby a stationary wave is generated in the shaft furnace. In addition, or alternatively, the modulation takes place in a way that causes the raw materials in the shaft furnace to descend evenly and especially in a plug-shaped formation. To that effect the modulation can be controlled as a function of measured process variables.

Another advantage of the method described lies in the effect it has on the geometry of the vortex zones by enlarging the region in which the principal coal conversion takes place. In other words, the performance of the shaft furnace, i.e. its efficacy, can be increased without an additional expenditure for energy or hardware.

Another aspect of the invention relates to a method of the type explained at the outset, whereby in a first operating phase at least one of the process variables is dynamically modulated upon the selection of a specific parameter, the effect of the modulation of the minimum of one process variable on at least one characteristic of the shaft furnace is recorded, whereupon the parameter is modified along a predefined system and the modified parameter is reset, the effect of each modification and resetting on the furnace characteristic is recorded, followed by the selection from among the recorded characteristic values corresponding to the modified parameters, within specific selection criteria, of a characteristic value along with the associated parameter value, and in a second operating phase the minimum of one process variable is dynamically modulated based on the selected parameter value. This method advantageously shows how the dynamic modulation can be suitably executed in that a parameter, which may for instance be the cycle time for a periodic modulation, is modified and as a result of such modification on the basis of a specific characteristic such as the effectiveness of the shaft furnace, an optimal parameter value (for instance an optimal cycle time) is selected for the dynamic (for instance periodic) modulation.

This optimization process can be advantageously extended to additional parameters, leading to an optimal number of parameters on the basis of which the dynamic modulation is implemented.

This invention also relates to a shaft furnace that can be operated using the innovative method. Specifically, the shaft furnace is designed and configured for the method according to the invention as explained above.

In a shaft furnace of this type, the injection system for the process gas includes a first and a second tubular element so that, in addition to a main conduit through which a portion of the process gas is introduced, an oxidant can be injected via the first tubular element and a supplemental reducing agent via the second tubular element. This is a technically simple way to permit the separate injection of an oxidant such as oxygen or oxygen-enriched air as well as a supplemental reducing agent into the shaft furnace, in turn permitting the mutually independent and physically convenient dynamic modulation of the injections. According to the invention, a corresponding control device is adjusted in a way as to change the process variables, i.e. the pressure p and/or volume flow $\dot{V}$, within a time span of $\leqq 40$ s.

It has been found to be particularly practical to at least in part combine the first and the second tubular elements into a dual-pipe lance, for which the tubular elements may be installed in concentric coaxial or in a side-by-side arrangement, thus accommodating the functional requirements of the tubular elements in a space-saving configuration.

It is equally possible, however, to install the first and the second tubular elements in the form of spatially separated lances, in which case at least one angle of emersion of one of the tubular elements relative to a horizontal and/or vertical plane of the shaft furnace is adjustable, and especially the angles of emersion of the two tubular elements are adjustable independent of one another. This permits a variation of the direction of injection of the added oxygen or of the supplemental reducing agent relative to the geometry of the vortex zone. Specifically, however, it would even permit a dynamic modulation, analogous to that described above, of the angle of emersion during the operation of the shaft furnace.

The feed lines into the shaft furnace are provided with valves, especially of a ceramic material, and in particular disk or magnetic-plunger valves that are highly heat-resistant and immune to temperature changes. These valves are subject to particularly low thermal expansion, thus permitting trouble-free performance even at the extremely high temperatures encountered during operation.

The process-gas injection system preferably connects to at least two reservoirs, which reservoirs are exposed to particularly pulsating stress. Specifically, the reservoirs differ in size and/or delivery pressure so that, as needed for attaining a particular modulation, the appropriate reservoir can be hooked up. It is also possible to connect several identical reservoirs so that, as the reservoir in use is emptied, the pressure in the reservoir [sic] drops only insignificantly, leaving enough time to refill that reservoir to its original level while the other reservoir is connected.

Characteristically, the process-gas injection system is provided with a first set of valves and a second, redundant set of valves. It is thus possible to alternate the operation of the individual sets, allowing the valves to cool off. The cooling process can be further improved by using a gas, especially an inert gas, to cool the valves that are not needed for injecting the process gas.

Another aspect of the invention specifies a method for operating a shaft furnace which, apart from the functional features described above, is characterized in that, from the upper section of the shaft furnace, the atmosphere prevailing in the top region of the shaft furnace is dynamically modulated. In this fashion, the above-described effect of a dynamic modulation, limited to the atmosphere in the vortex zones, can be extended to a larger region for instance by a dynamic modulation of the stack gas present in the throat area of the shaft furnace. That can be accomplished for instance by injecting additional gas in the shaft furnace top section and/or by modulating the stack-gas pressure through the appropriate control of valves provided in the stack-gas downtake.

Specifically, a dynamic modulation taking place at the tuyère level and the dynamic modulation taking place in the top (throat) section can be mutually tuned. This will permit additional resonant stimulations of a partial segment of the atmosphere in the shaft furnace, which in turn can further improve the through-gassing in the shaft furnace. These dynamic modulations can be advantageously tuned to one another for instance in terms of periodicity and amplitude, in a manner whereby an additional, direct resonant stimulation is generated or the stimulation of a partial segment of the atmosphere prevailing in the shaft furnace will only take place through a coupling effect of the external stimulations.

BRIEF DESCRIPTION OF THE DRAWINGS

Other advantages and details of the invention will become evident from the following explanation of the attached drawings in which.

DESCRIPTION OF THE PREFERRED EMBODIMENT

Figure 1:
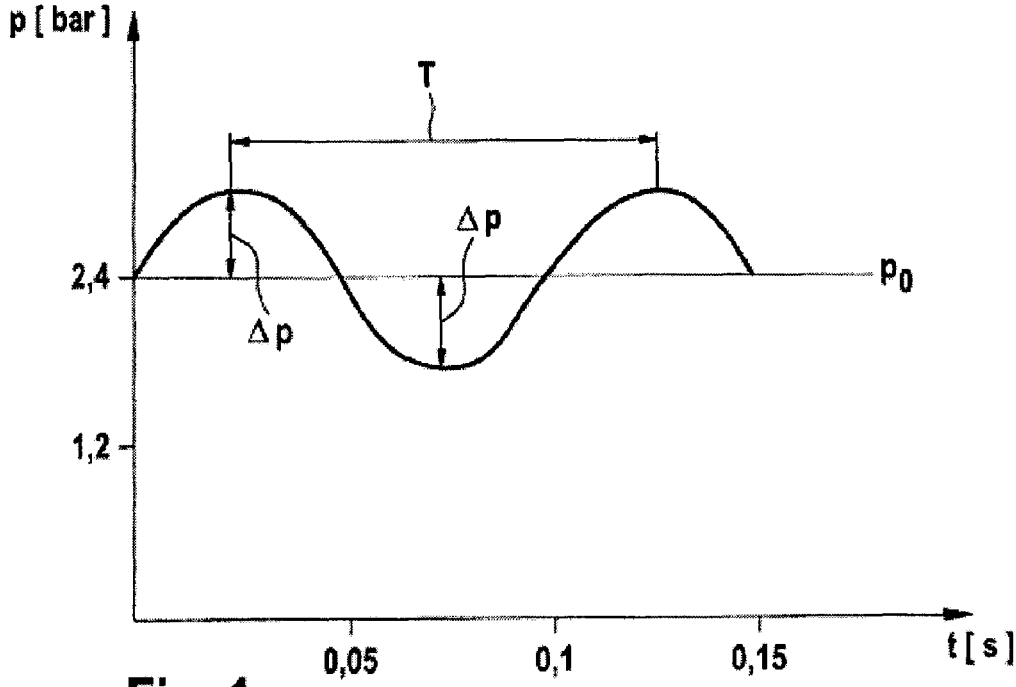
FIG. 1 is a time/pressure diagram.

FIG. 1 illustrates how the pressure for instance of the process gas being injected in the shaft furnace can be dynamically modulated. As shown, the pressure p(t) fluctuates harmonically around a base pressure $p_o$, at a frequency of $f=1/T=10$ Hz. In this example, the base pressure $p_o$ is 2.4 bar. The pressure amplitude $2\Delta p$ in this example is 1.2 bar, which is 50% of the base pressure value $p_o$. Accordingly, the pressure pattern of the hot forced gas, shown in FIG. 1, is determined by $P(t)=p_o+\Delta p \text{ sine } (2\pi\, t/T)$.

Figure 2:
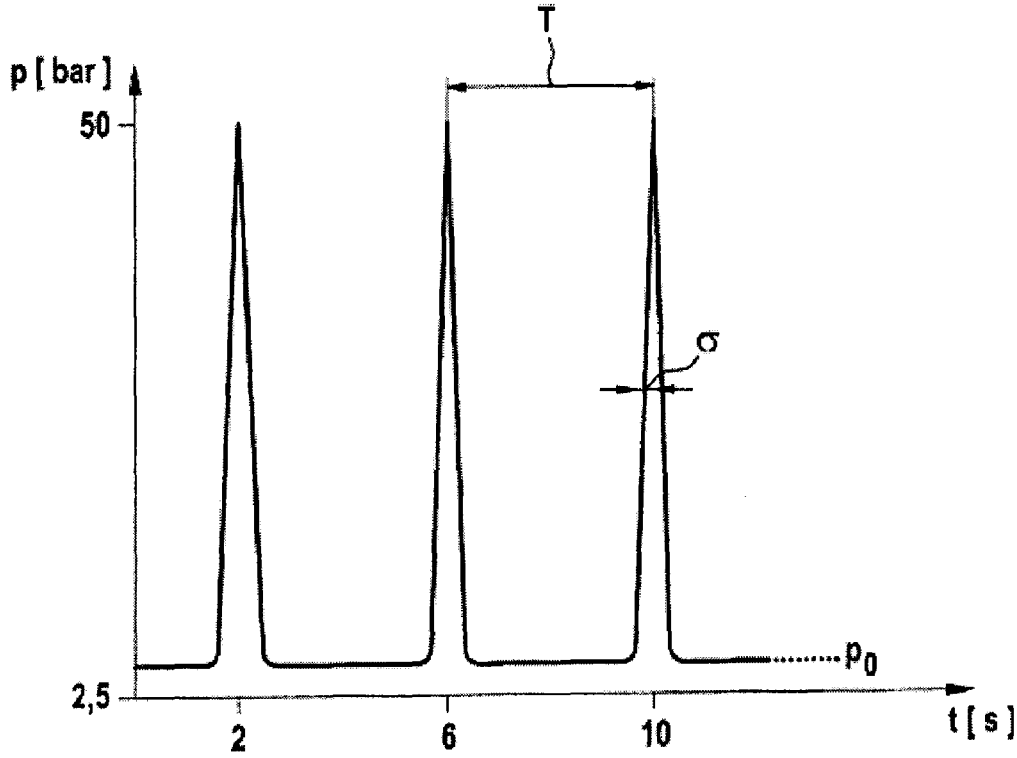
FIG. 2 is another time/pressure diagram.

FIG. 2 shows a pulsed modulation of the pressure of a process gas component being injected in the shaft furnace. Specifically, this may be pure oxygen that is injected in the shaft furnace in addition to the hot forced gas. In this case as well, the modulation is periodic, albeit with a cycle time of T=4 s. The pulse height $p_{max}$ is 50 bar which, given an ambient pressure of the injected hot forced gas for instance of 2.5 bar, represents a pulsation with an amplitude factor of 20. The pulse width $\sigma$ of the pulses is about 0.4 s which results in a pulse width/pulse length ratio of approximately 0.1.

Figure 3:
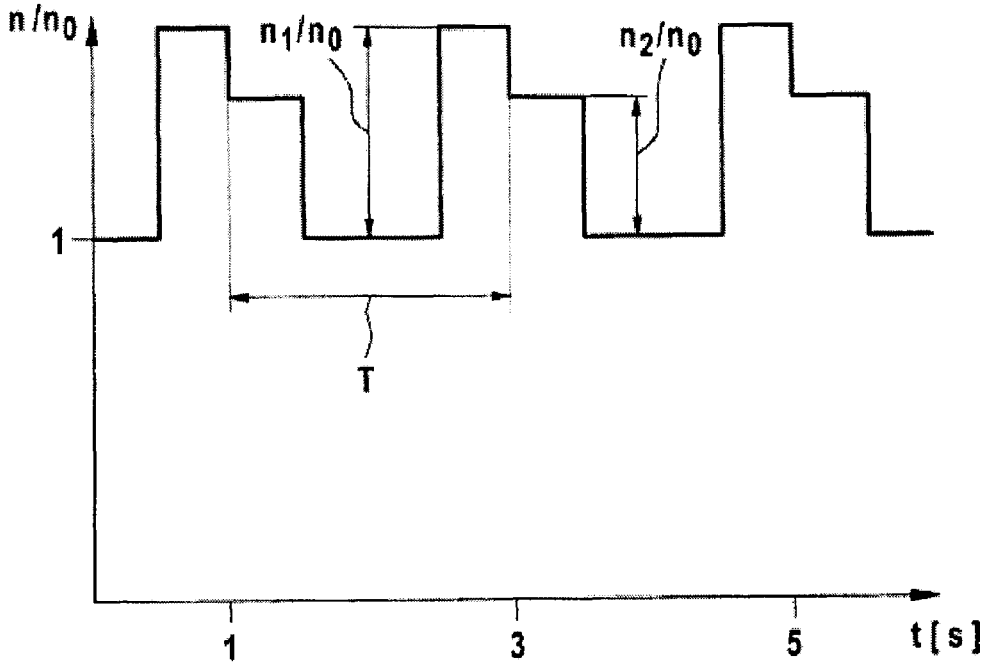
FIG. 3 is a time/concentration diagram.

FIG. 3 illustrates an example of the dynamic modulation of the oxygen concentration in the process gas. It is arrived at as follows: An unmodulated hot forced-gas component of the process gas supplies a constant base concentration $n_o$ which corresponds to the natural oxygen concentration in air (the hot forced gas in this example consists of hot air). In addition to the hot forced gas two more components of the process gas are now introduced. A first component, consisting either of pure oxygen or of an oxygenated gas phase with an oxygen concentration of $n'_1$, is introduced in periodically pulsed fashion with a cycle time $T_1$ of 2 s. The amount of pure oxygen or the oxygen concentration $n'_1$ is so selected that in relation to the total process gas the oxygen concentration is increased by the concentration differential of $n_1$. In the case shown the $n_1/n_o$ ratio is about 60%. In analogous fashion an additional, second gas phase is introduced in a pulsed mode, with the pulsation again taking place periodically with the same cycle time of $T_2=T_1$ but phase-shifted by a phase $\phi_1$. This second gas component, introduced in phase-shifted, pulsed fashion results in an increase in the oxygen concentration relative to the total process gas from $n_o$ to $n_o+n_2$ as shown in FIG. 3. The $n_2/n_o$ ratio is approximately 40%, meaning that the second gas phase effectively adds less oxygen to the process gas than does the first one. As is quite evident from FIG. 3, all of the oxygen concentration n(t) of the process gas is periodic, with a cycle time $T=T_1=T_2$ since it is the result of the superposition of two (or three including $n_o$) periodically modulated gas phases. In the example shown in FIG. 3 the phase shift $\phi_1$ is about $\pi/2$, although it would be possible to set it at $\pi$, in which case the two additional gas phases would be anticyclical. That would make the oxygen concentration n(t) quasi-periodic with a cycle time of T/2. Without a phase shift ($\phi_1=0$) the resulting oxygen concentration n(t) would be equally obtainable with a single, additionally injected gas phase.

Figure 4:
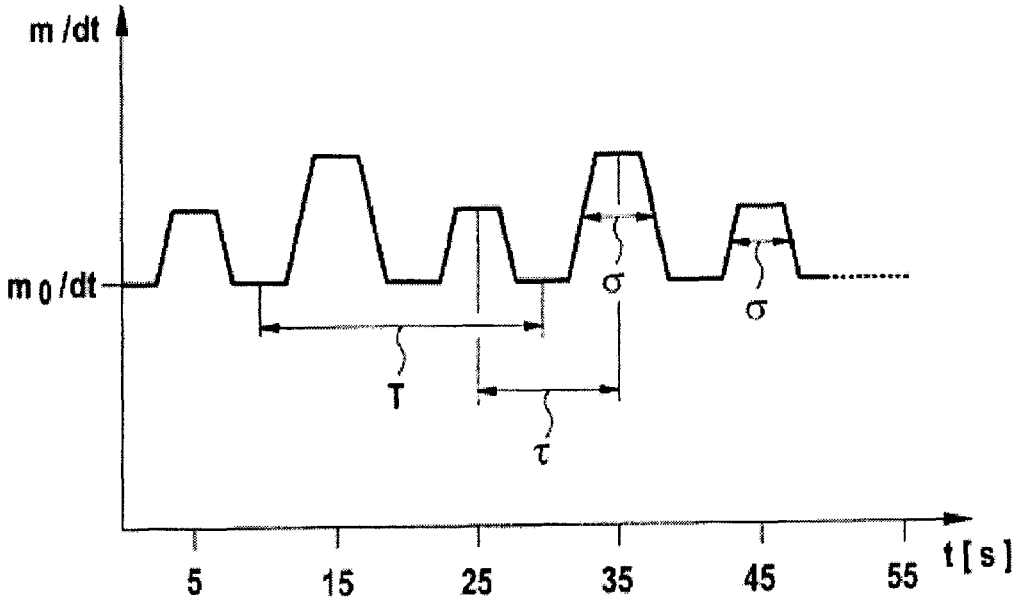
FIG. 4 is a time/mass-flow diagram.

FIG. 4 shows the time-based modulation of the injection rate of supplemental reducing agents which in this example could be coal dust, for instance corresponding to the mass flow m/dt. In this case as well, a continuous mass flow $m_o/dt$ is overlaid by a pulsed additional component which produces an increase by 30% once every T=20 s and, in the anticyclic mode, a 50% increase every T=20 s. Consequently, the total mass flow m/dt has a cycle time T but is quasi-periodic with $\tau=T/2$. The pulse width $\sigma$, at about T/4, is relatively significant in this case.

Figure 5:
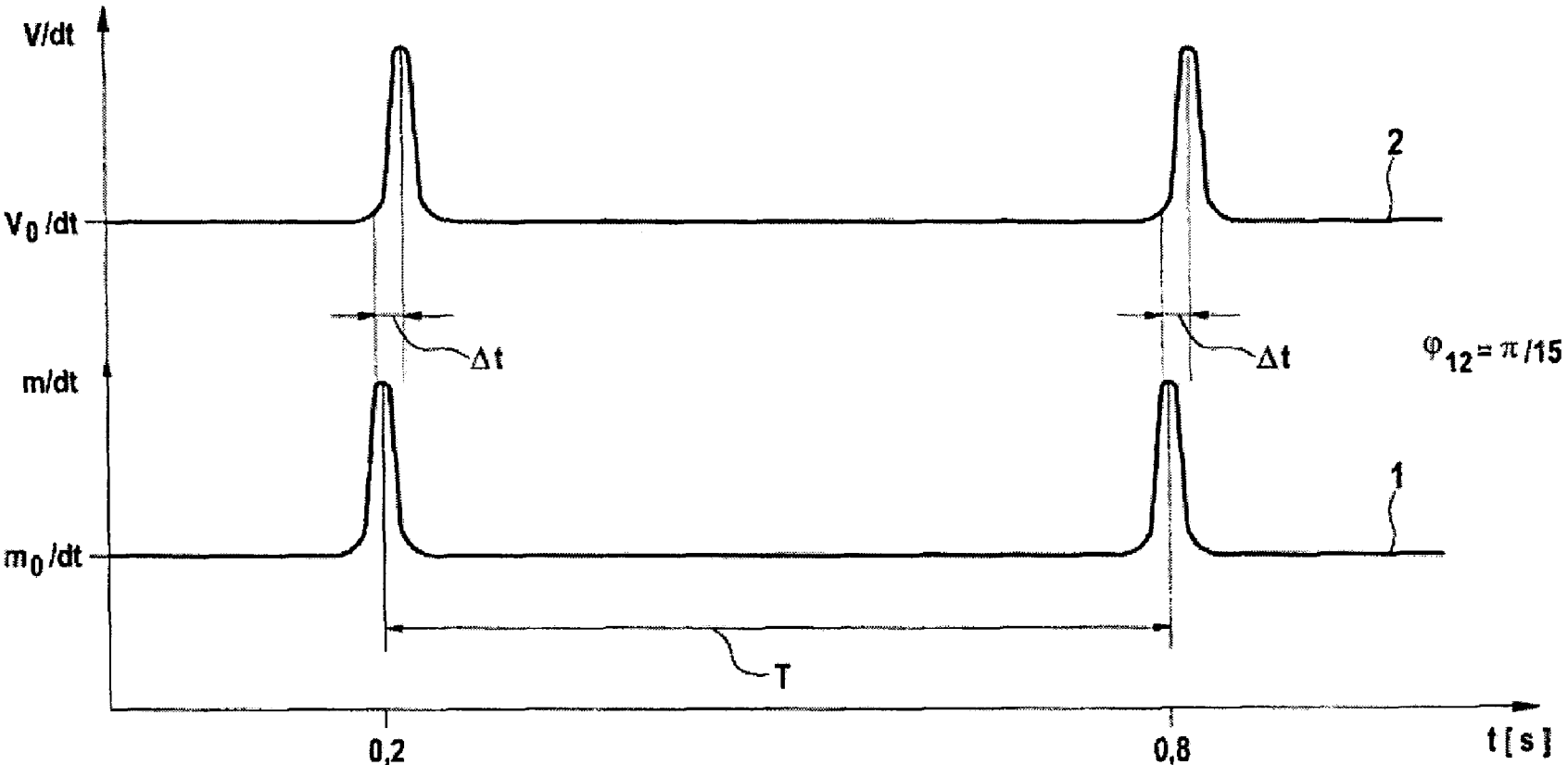
FIG. 5 is a combination time/mass/volume-flow diagram.

FIG. 5 shows the simultaneous, isochronous modulation of both the mass flow m/dt of a supplemental reducing agent and a volume flow V/dt of oxygen. Conditions similar to those described above for FIG. 4 apply to the mass flow m/dt, except that the pulse shape is different and the cycle time T in FIG. 5 is T=0.6 s. The time-based modulation of the oxygen volume flow V/dt, likewise occurring periodically with a cycle time T, can be generated for instance in that a portion $V_o/dt$ is provided by the natural oxygen volume flow of the injected hot forced gas and is periodically increased by additionally injected oxygen pulses. As can be seen in FIG. 5, the added oxygen pulses are shifted relative to the pulsation of the mass flow of the supplemental reducing agent by a time $\Delta t=0.02$ s, which corresponds to a phase shift of $\phi_1=\pi/15$. As a result of the phase shift thus selected, the incremental amount of the supplemental reducing agent injected in the vortex zone has a head start on the next-following oxygen pulse and is to a degree available for the conversion, while the trailing oxygen pulse can bring about the conversion of the supplemental reducing agent before the latter leaves the vortex zone. As a consequence, a reliably high conversion rate is achievable for the supplemental reducing agent concurrently with an increased injection rate, leading to improved through-gassing in the shaft furnace.

The example, explained with the aid of FIG. 1 to 5, of a dynamic modulation of the injection of the process gas and other components merely represents a fraction of the possibilities to implement the dynamic modulation according to the invention. As will be evident from the various design examples, the characterizing features of the invention disclosed in the above description and in the patent claims can serve as key elements, individually and in any combination, in the implementation of the invention in its various configurations.

Assuming for example that the shaft furnace is a blast furnace with an internal pressure of about 2 to 4 bar. The process gas may be injected at a continuous pressure of about 10 bar. For a pulsed modulation a reservoir, with a pressure for instance of 20 bar, may be temporarily connected via a valve. Connecting the reservoir can generate for instance a short pulse increasing the pressure by 1.5 to 2.5 bar, meaning that for the duration of that pulse the process gas pressure is about 12 bar. Within the blast furnace, this pulse generates an energy spike that melts caking and slag in the peripheral area of the reaction zone and/or punches holes through the layer of caking and slag. Since that energy spike pumps oxygen into the slag layer in the reaction zone, it causes oxidizing reactions with the slag layer. The loosening of the slag permits better through-gassing throughout the blast furnace. At a minimum, slag formation can be reduced by adding to the process gas smallest possible coal particles, so that the reaction in the reaction zone results in fewer unburned components which might otherwise deposit themselves in the slag. The modulation effect in the injected process gas can be intensified by providing multiple injection ports around the circumference and/or along the vertical walls of the blast furnace.

In the example of a cupola-type shaft furnace, it may essentially be configured and operated in a manner similar to the blast furnace described above. A cupola furnace is usually operated at a lower pressure, for instance at 300 mbar. In that case the process gas can be injected at a pressure of 5 bar while the associated reservoir may have a pressure of 12 bar.

What is claimed is:

1. Method for operating a shaft furnace, whereby an upper section of the shaft furnace is charged with raw materials which due to gravity descend inside the shaft furnace while an atmosphere prevailing within the shaft furnace causes part of the raw materials to melt and/or to be reduced, and in a lower section of the shaft furnace a process gas is injected so as to at least partly modify the atmosphere prevailing in the shaft furnace, whereby the injection of the process gas is dynamically modulated in a manner whereby in the modulation, the process pressure p and/or volume flow $\dot{V}$, are varied at least intermittently within a time span of $\leqq 40$ s and whereby the process gas is injected into the blast furnace through at least two different channels, a first process variable serving to control the process-gas component being injected along the first channel is dynamically modulated and a second process variable serving to control the process-gas component being injected along the second channel is dynamically modulated, the first and the second process variables are identical process variables modulated differently or the first and the second process variables are mutually different but subjected to identical modulation, and whereby the first and the second process variables are periodically modulated with an identical cycle time T while their relative phase is shifted by a specific value.

2. Method as in claim 1, whereby the modulation takes place in pulsed fashion, with the pulse width $\sigma$ of a pulse being $5\ s \geqq \sigma \geqq 1$ ms.

3. Method as in claim 1, whereby the modulation takes place by way of adjustment of at least one process variable, the pressure p and/or $\dot{V}$, controlling the injection of the process gas.

4. Method as in claim 1, whereby an inverse cycle time $T^{-1}$ is set at a self-resonant frequency of a partial system of the atmosphere within the blast furnace.

5. Method as in claim 1, whereby at least intermittently the process gas contains, in part or entirely, an inert gas serving to cool valves positioned in the volume flow of the process gas.

6. Method as in claim 1, whereby the process gas is modulated in a manner such as to generate a stationary wave of the process gas in the shaft furnace.

7. Method as in claim 1, whereby the injection of the process gas is so regulated that the raw materials descend within the shaft furnace in uniform fashion in a plug-shaped formation.

8. Method as in claim 1, whereby the modulation takes place with a cycle time T of $40\ s \geqq T \geqq 0.5$ s.

9. Method as in claim 1, whereby the modulation takes place with a cycle time T of $10\ s \geqq T \geqq 0.5$ s.

10. Method as in claim 1, whereby the modulation takes place in harmonic fashion.

11. Method for operating a shaft furnace, whereby an upper section of the shaft furnace is charged with raw materials which due to gravity descend inside the shaft furnace while an atmosphere prevailing within the shaft furnace causes part of the raw materials to melt and/or to be reduced, and in a lower section of the shaft furnace a process gas is injected so as to at least partly modify the atmosphere prevailing in the shaft furnace, whereby the injection of the process gas is dynamically modulated in a manner whereby in the modulation, the process pressure p and/or volume flow $\dot{V}$, are varied at least intermittently within a time span of $\leqq 40$ s and whereby an inverse cycle time $T^{-1}$ is set at a self-resonant frequency of a partial system of the atmosphere within the blast furnace.

12. Method as in claim 11, whereby the modulation takes place in pulsed fashion, with the pulse width $\sigma$ of a pulse being $5\ s \geqq \sigma \geqq 1$ ms.

13. Method as in claim 11, whereby the modulation takes place by way of adjustment of at least one process variable, the pressure p and/or $\dot{V}$, controlling the injection of the process gas.

14. Method as in claim 11, whereby the process gas is injected into the blast furnace through at least two different channels, a first process variable serving to control the process-gas component being injected along the first channel is dynamically modulated and a second process variable serving to control the process-gas component being injected along the second channel is dynamically modulated, the first and the second process variables are identical process variables modulated differently or the first and the second process variables are mutually different but subjected to identical modulation.

15. Method as in claim 11, whereby the first and the second process variables are periodically modulated with an identical cycle time T while their relative phase is shifted by a specific value.

16. Method as in claim 11, whereby at least intermittently the process gas contains, in part or entirely, an inert gas serving to cool valves positioned in the volume flow of the process gas.

17. Method as in claim 11, whereby the process gas is modulated in a manner such as to generate a stationary wave of the process gas in the shaft furnace.

18. Method as in claim 11, whereby the injection of the process gas is so regulated that the raw materials descend within the shaft furnace in uniform fashion in a plug-shaped formation.

19. Method as in claim 11, whereby the modulation takes place with a cycle time T of $40\ s \geqq T \geqq 0.5$ s.

20. Method as in claim 11, whereby the modulation takes place with a cycle time T of $10\ s \geqq T \geqq 0.5$ s.

21. Method as in claim 11, whereby the modulation takes place in quasi-periodic fashion.

22. Method as in claim 11, whereby the modulation takes place in periodic fashion.

23. Method as in claim 11, whereby the modulation takes place in harmonic fashion.

* * * * *